US005997376A

United States Patent [19]

Block et al.

[11] Patent Number: 5,997,376

[45] Date of Patent: Dec. 7, 1999

[54] SURBOARD FIN MOUNTING SYSTEM

[76] Inventors: Larry A. Block, 4505-1D Industrial St., Simi Valley, Calif. 93063; Dennis L. Daum, 134 Calle de Los Molinos; Thomas L. O'Keefe, 121 Del Gado Rd., both of San Clemente, Calif. 92672

[21] Appl. No.: 09/199,207

[22] Filed: Nov. 24, 1998

[51] Int. Cl.[6] ..... B63B 1/00

[52] U.S. Cl. ..... 441/79; 441/74

[58] Field of Search ..... 114/140, 39.14, 114/39.15, 357; 441/65, 74, 75, 79

[56] References Cited

U.S. PATENT DOCUMENTS

| | | | |
|---|---|---|---|
| 3,747,138 | 7/1973 | Morgan | 441/79 |
| 4,805,546 | 2/1989 | Geller et al. | 441/79 |
| 4,904,215 | 2/1990 | Sherwood | 114/140 |
| 5,133,681 | 7/1992 | Lobe | 441/79 |
| 5,493,989 | 2/1996 | Anderson | 441/79 |

*Primary Examiner*—Ed Swinehart

*Attorney, Agent, or Firm*—Jack C. Munro

[57] ABSTRACT

A fin mounting system for a surfboard which utilizes a box embedded within the surfboard with the mounting being achieved by producing a through cavity within the surfboard, placing the box within the through cavity and then pouring a hardenable resin between the box and the sidewall of the cavity completely filling such. The box is constructed of a glass filled polyurethane plastic. After the resin is hardened, any portion of the box that protrudes exteriorly of the surface of the surfboard is removed. The fin has a mounting end which is to be transversely snugly received within the box. The fin is adjustable longitudinally within the box. A fastener is employed to fix in position the fin when the desired adjusted position is achieved. The fin is constructed of a glass-filled, nylon material. The fastener comprises a conventional bolt and nut with the nut being embedded within the fin. The fin includes an enlarged recess directly in alignment with the nut which facilitates insertion of the bolt in conjunction with the fin facilitating engagement with the nut. The box may include a leash attachment section.

4 Claims, 2 Drawing Sheets

SURBOARD FIN MOUNTING SYSTEM

BACKGROUND OF THE INVENTION

1. Field of the Invention

The field of this invention relates to surfboards and more particularly to a mounting system for the fins in conjunction with a surfboard.

2. Description of the Prior Art

Surfboards are known to have between one and three fins mounted on the undersurface of the surfboard. The purpose of the fins are to provide control to the rider when the surfboard moves through water. In the past, these fins have been mounted permanently in conjunction with the board. This permanent type of mounting as certain disadvantages. One disadvantage is that when the board is being shipped or carried from one location to another, the overall size of the surfboard is significantly increased. Elimination of the fin or fins will substantially reduce the size of the surfboard especially if it is contained within a surfboard carry bag. If the surfboard is carried on board an airplane, it is common for the carrier to charge a fee for each surfboard that is being carried. If the fin could be removed, in the same space that a single board would occupy, there could be placed within a carry bag three in number of surfboards. Generally, a single carry bag is only charged the fee for a single surfboard even though there are two or three in number of surfboards within the bag.

Additionally, the protrusion of the fin or fins substantially increases the possibility of damage to the surfboard when being transported. The fin can strike and object or an object can strike the fin which can result in the fin actually being broken or the mounting arrangement of the fin could be damaged.

Within recent years, it has been known to mount a surfboard fin in a removable manner in conjunction with the surfboard. A box is utilized which is embedded within the board and then the fin is then mounted in conjunction with the box. This mounting permits removing of the fin during times of transporting of the surfboard.

Another advantage of mounting the fin in conjunction with a box embedded within the surfboard is that if the box is made of an extended length, then the fin can be adjusted to different longitudinal positions within the box. Once an established longitudinal position is achieved, the fin is then fixed into position to the box. Some surfboard riders are classified as beginners with other surfboard riders having a more intermediate skill level and more advanced riders having advanced skill. It has been discovered that a beginning type of rider generally desires the surfboard fin or fins to be located in a certain position while an intermediate skill level of rider desires a slightly different position for the fin or fins. Still further, the advanced skill level rider desires a still further different position of the fin or fins. Permitting adjustment of the fins achieves the individual different skill level for each of the riders.

In the past, this adjustment requires the insertion of a fastener through a confined opening in the box that is embedded within the surfboard. The connection of that fastener to the fin is not easily accomplished as there is no structure within the fin that facilitates this connection.

Additionally, most surfboard riders have a desire to use a leash which is a lanyard which is attached between the rider and the surfboard. When the rider falls from the surfboard, the surfboard is maintained in close proximity to the rider by the leash. It is common to embed within the board a leash attachment which is separate from the mounting system for the fins. This requires an inclusion of an additional structure to be mounted in conjunction with the board.

SUMMARY OF THE INVENTION

The fin mounting system of the present invention comprises a glass-filled, polyurethane plastic box which is to be embedded within the surfboard with there being a separate box for each fin. The position of the embedding of the box or boxes within the surfboard is preselected. The position of the box is oriented at a desired angle so that the fin that is mounted in conjunction with the box will be positioned at the particular desired angle as the fin moves through the water. Each box has a through opening which is composed of an upper section and a lower section. Within the upper section there is located the mounting end of the fin which is transversely restrained. However, longitudinal adjustment to about three-quarters of an inch is permitted of the fin relative to the box. Once the desired longitudinal position is achieved, a bolt-type fastener is to be passed through the lower section of the through opening and then tightly engaged with a nut that has been previously embedded within the fin. The box may include a leash attachment section with the leash attachment section to connect with a pin with this pin being connected to a lanyard with the lanyard extending exteriorly of the surfboard. This lanyard is normally attached to a separate strap or lanyard which is then to be connected to the rider. The upper section of the box terminates in rounded ends which increases the length for adjustability of the fin within the box and also significantly increases the overall strength of the box by eliminating the shear points produced by ninety degree sharp corners. The box has an exterior on which are located a plurality of reinforcing ribs and a plurality of recesses each of which function to produce a high strength mounting when embedded within the surfboard by using of a hardenable resin. The box has a raised lip directly surrounding the upper section of the through opening with this raised lip to be used to avoid flowing of the liquid resin into the through opening during the mounting procedure of the box within the surfboard.

One of the primary objectives of the present invention is to construct an ultra-light box that is to be used in conjunction to mount a fin in conjunction with a surfboard with this ultra-light box being formed within an incredibly strong, glass filled, polyurethane plastic material.

Another advantage of the present invention is that the surfboard fin that is mounted with the mounting system of the present invention permits the surfboard fin to mount flush to the board with the mounting base of the fin extending deeply into the surfboard to give the fin a solid base in essence making the fin and the surfboard a single unit.

Another advantage of the present invention is that the mounting system for the surfboard fin of the present invention allows increased adjustability over a similar type mounting system for fins within the prior art.

Another advantage of the present invention is that the fin mounting system of the present invention may include a built-in leash attachment making it unnecessary to install a separate leash cup within the surfboard thereby saving time and money.

Another objective of the surfboard mounting system of the present invention is that surfboards will move quicker through the water and are more responsive than surfboards that don't use the fin mounting system of the present invention.

Another objective of the present invention is that since the fin mounting system is removable from the boards, a manufacturer is able to ship four to five boards in a single box that would normally hold no more than three boards. Also, because the fins have been removed, there has been eliminated the possibility of broken fins or broken mountings during the shipping procedure.

DETAILED DESCRIPTION OF THE PREFERRED EMBODIMENT

Figure 1:
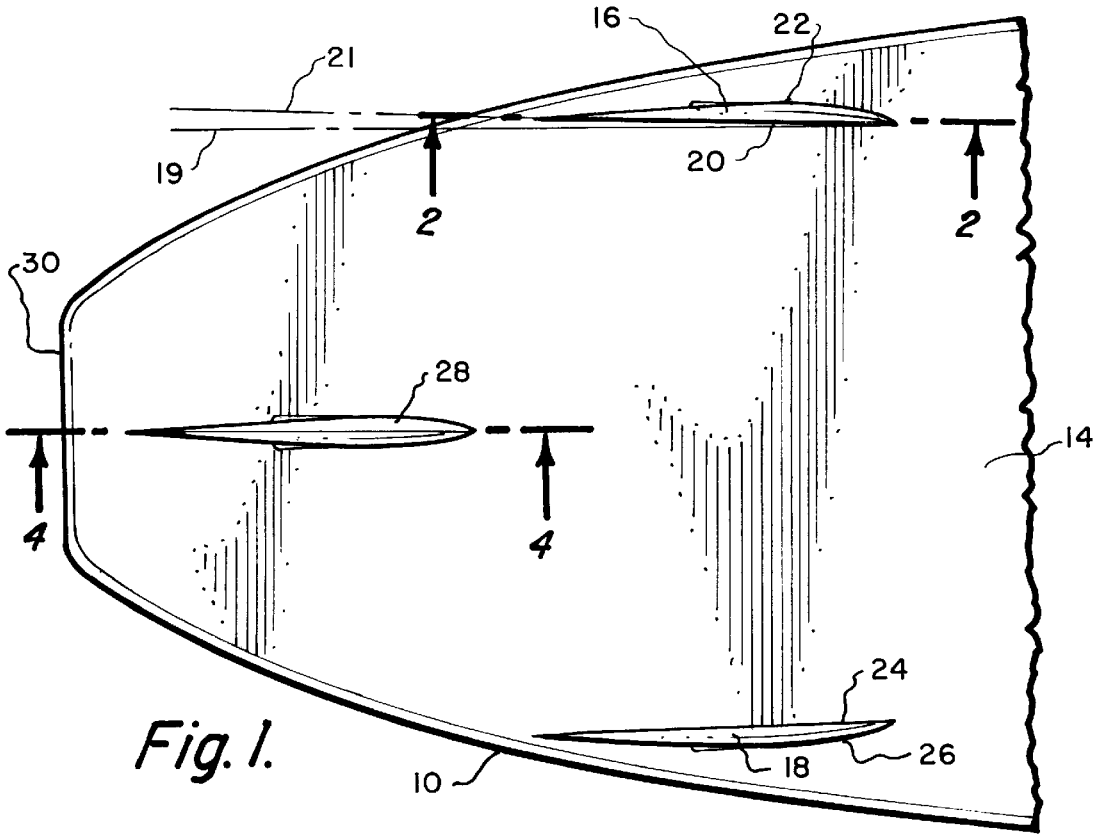
FIG. 1 is a plan view of the rear portion and bottom surface of a surfboard upon which has been installed a fin mounting system composed of three separate fins utilizing the mounting system of the present invention.

Referring particularly to the drawings, there is shown a conventional surfboard 10 which has an upper surface 12 and a bottom surface 14. It is to be understood that a rider will normally stand on the upper surface 12. For reasons of control, it is required to include a type of protruding fin arrangement from the bottom surface 14. This fin arrangement will provide to the surfboard 10 the desired control when moving through the water.

The fin arrangement comprises a right outboard fin 16 and a left outboard fin 18. It is to be noted that the inner surface 20 of the fin 16 is flat with the outer surface 22 having an airfoil or bowed shape. Regarding the left outboard fin, its inner surface 24 is also flat and its outer surface 26 has an airfoil shape. This airfoil configuration of the fins 16 and 18 is to create slight forces that assist in control of the surfboard 10. The fins 16 and 18 are in transverse alignment relative to the surfboard 10.

In between the fins 16 and 18 there is located a center fin 28. The entire exterior surface of the center fin 28 is in the shape of an airfoil. Therefore, the forces are balanced on the opposite sides of the fin 28 as it moves through the water. The center fin 28 is spaced rearwardly from the transverse alignment between the fins 16 and 18 with the center fin 28 being located directly adjacent the trailing end 30 of the surfboard 10.

It is to be noted that the longitudinal center axis through the fin 28 coincides with the longitudinal center axis of the surfboard 10. Generally, the right outboard fin 16 is pointed toward a point of intersection of the longitudinal center axis of the surfboard 10 with the front end (not shown) of the surfboard 10. The left outboard fin 18 is also orientated so that it points directly to the same point of intersection. This angling of the fins 16 and 18 is depicted by the longitudinal axis 21 of fin 16 being centered relative to the longitudinal axis 19 of the surfboard 10 with axis 19 being parallel to the longitudinal center axis (not shown) of surfboard 10.

The right outboard fin 16 has a mounting end 32 with a similar such mounting end (not shown) being part of the left outboard fin 18. Embedded within the mounting end 32 is a fastener nut 34. Connecting to the center of the fastener nut 34 is a hole 36. The mounting end 32 is to be snugly located within the upper section 38 of a through opening formed within a box 40. The through opening formed within the box 40 also includes a lower section 42. Interconnecting between the upper section 38 and the lower section 42 is a slot 44. The slot 44 is narrow to permit passage of a bolt fastener body 46 therethrough. However, the head 48 does not pass through the slot 44 and abuts against the sidewalls forming the slot 44. The body 46 is to be located within the hole 36 and then connect with the nut 34. It is to be noted that the hole 36 is oversized relative to the body 46 which facilitates initial connection of the body 46 with the fin 16. Once the body 46 is positioned within the hole 36, it is then an easy matter to rotate the head 48 causing the body 46 to become engaged with the nut 34. The fastener composed of the body 46, the head 48 and the nut 34 is used to securely fix in position the fin 16 relative to the box 40. The box 40 is to be made of a polyurethane plastic which is filled with about forty percent glass fibers. Each of the fins 16, 18 and 28 is to be constructed of a nylon material that is fifty percent filled with glass fibers.

Figure 2:
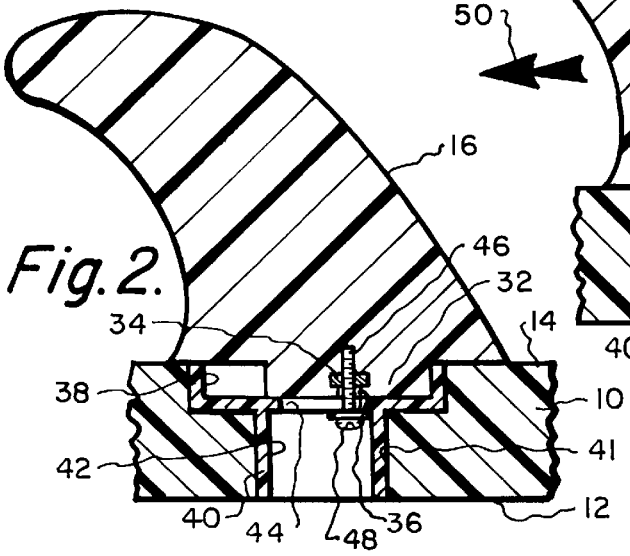
FIG. 2 is a cross-sectional view through one of the outboard fins that are mounted by the fin mounting system of the present invention taken along line 2—2 of FIG. 1 showing the fin in a foremost adjusted position.
Figure 3:
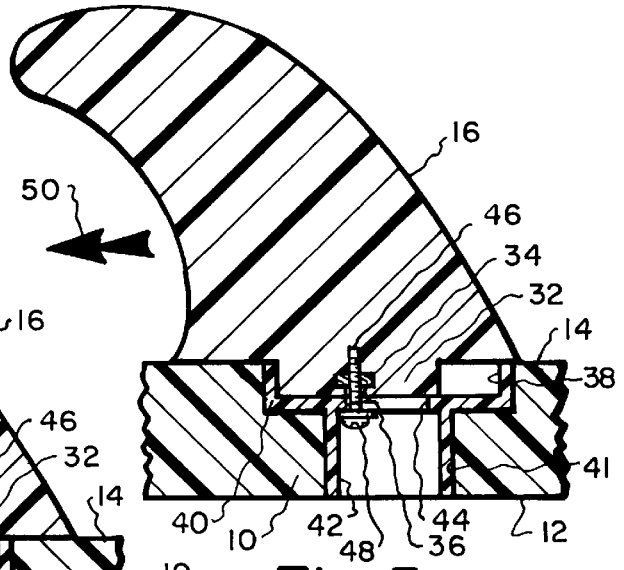
FIG. 3 is a view similar to FIG. 2 but showing the fin having been moved to a rearmost adjusted position.
Figure 4:
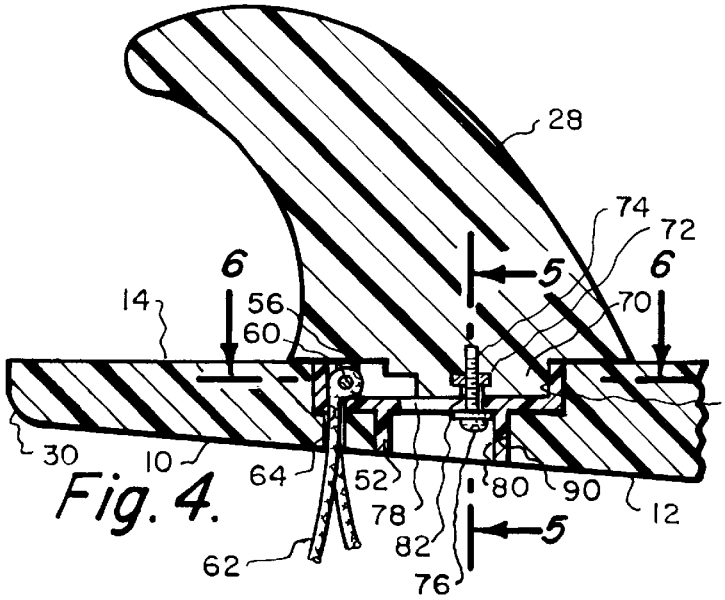
FIG. 4 is a cross-sectional view through the center fin of the fin mounting assembly of the present invention taken along line 4—4 of FIG. 1 showing in detail the leash attachment that is incorporated with this center fin mounting.
Figure 5:
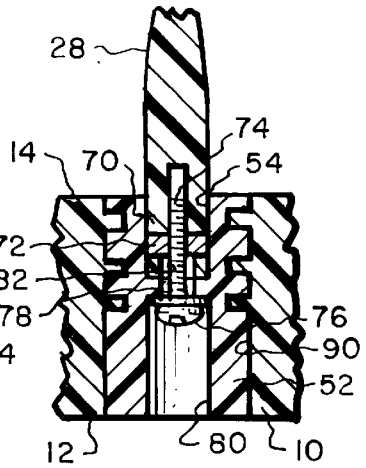
FIG. 5 is a cross-sectional view taken along line 5—5 of FIG. 4.
Figure 6:
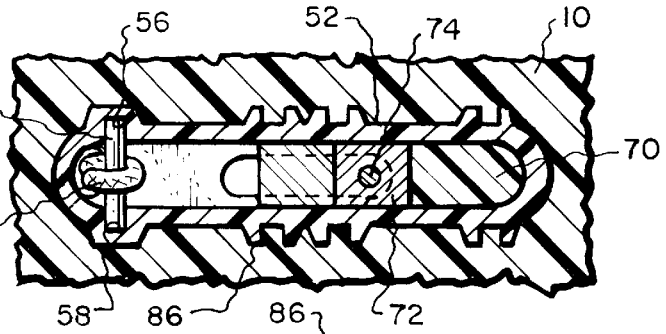
FIG. 6 is a longitudinal cross-sectional view taken along line 6—6 of FIG. 4.

The width of the mounting end 32 is just about equal to the width of the upper section 38 forming a snug transverse fit therebetween. However, the length of the mounting end 32 is shorter than the length of the upper section 38. This permits the fin 16 to be moved from the foremost position as shown in FIG. 2 to the rearmost position shown in FIG. 3 as indicated by arrow 50. It is to be understood that movement of the fin 16 is only to be accomplished when the fasteners 46 and 48 are loosened from the nut 34. Once a desired location of the fin 16 has been obtained, the fastener is then tightened thereby fixing in position the fin 16 relative to the surfboard 10. It is to be understood that a similar mounting arrangement is to be accomplished for the fin 18 as discussed in relation to fin 16.

It is to be understood that the mounting of the box 40 within the surfboard 10 is accomplished by locating of the box within an opening that has been precut within the surfboard 10. There is formed a certain amount of space, which is not shown, located about the box 40 and the sidewall of the hole 41 formed within the surfboard 10. This space is to be filled with a hardenable resin, which is not shown. Once the resin hardens, the box 40 is fixedly mounted within the body of the surfboard 10.

Referring particularly to FIGS. 4–8 of the drawings, there is shown a box 52 which is designed to be used in particular for the center fin 28. The box 52 is essentially identical to the box 40 with the exception that within one end of the upper section 54 there are formed a pair of oppositely facing grooves 56 and 58. A pin 60 is to be positionable between the grooves 56 and 58. A lanyard 62 is wound about the pin 60 with the ends of the lanyard 62 extending through a hole 64 formed within the surfboard 10. The portion of the lanyard 62 formed that extends from the surfboard 10 is to be attached to a strap, which is not shown, which is to be connected to a body part such as an ankle of the rider. The pin 60 and the lanyard 62 is commonly termed a leash attachment.

It is to be noted that the box 52 includes rounded ends 66 and 68 formed within the upper section 54. Also, the rounded ends 66 and 68 significantly increases the overall strength of the box 52 eliminating the shear stresses that are created by ninety degree sharp corners. The reason for the rounded ends 66 and 68 is to maximize the length of adjustment of the mounting end 70 of the center fin 28. Embedded within the mounting end 70 is a nut 72 which is to connect with a threaded body 74 of a bolt fastener which includes an enlarged head 76. In the same manner which was previously discussed in relation to the fin 16, the threaded body is to connected with the nut 72 by being conducted through slot 78 of the box 52. The slot 78 is located between the upper section 54 and the lower section 80 of the through opening which extends entirely through the box 52. Fin 28 includes an oversized hole 82 which facilitates initial engagement movement of the body 74 with the fin 28. Assistance in the connection of the body 74 with the fin 28 is desirable because the fastener, composed of head 76 and body 74, must be inserted through the confining lower section 80 and in essence the installer is working "blind" so it is helpful to have the body 74 initially "fall into" the oversized hole 82 prior to engaging with the nut 72.

The box 52 has an exterior surface which includes a plurality of recesses 84. The exterior surface of the box 52 also includes a plurality of ribs 86. Between the ribs are cavities and within these cavities liquid resin flows and fills such and which also occurs with respect to the recesses 84. Therefore, when the resign hardens, the ribs 86, recesses 84 and cavities 88 function to tightly interlock and maintain secure the position of the box 52 within the surfboard 10. It is to be understood that similar cavities, ribs and recesses are formed within the box 40.

Figure 7:
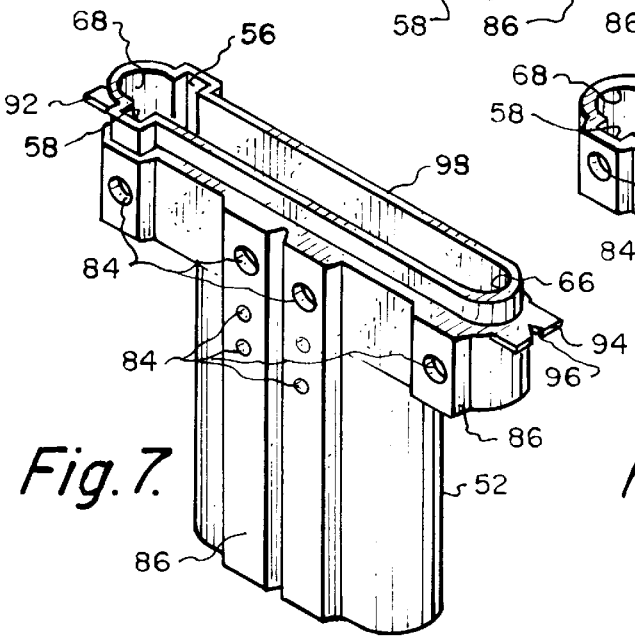
FIG. 7 is an isometric view of the box which includes the leash attachment showing the shape of the box prior to embedding of the box within the surfboard.
Figure 8:
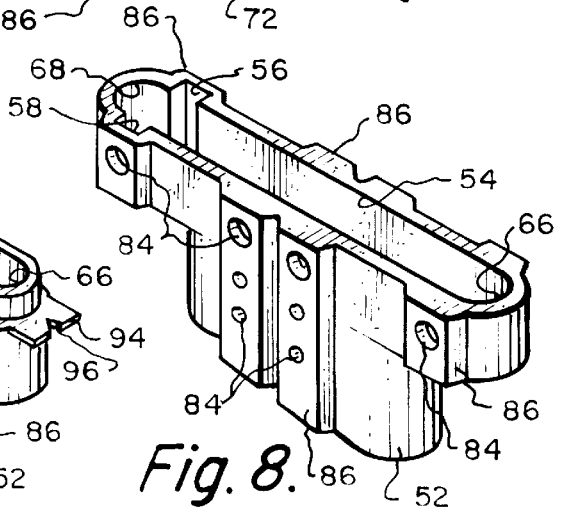
FIG. 8 is an isometric view showing the shape of the same box of FIG. 7 showing its approximate configuration when embedded within the surfboard.

Referring particularly to FIGS. 7 and 8, it can be seen that the box 52 is substantially larger in size than FIG. 7. When the box 52 is located within the hole 90 formed within the surfboard 10, the box 52 is precisely positioned. Positioning flanges 92 and 94 are used to be placed against the bottom surface 14 of the surfboard 10 prior to pouring of the resin. A notch 96 in flange 94 and a similar notch (not shown) in flange 92 are used to center the box 52 in position. The tubular body portion of the box 52 is shown to be a lot longer in FIG. 7 than in FIG. 8. This will extend some spaced distance from the upper surface 12. Also extending outward from the bottom surface 14 is an enclosing lip 98. The resin is to be poured in the space provided between the hole 90 and the box 52 completely filling such. The function of the lip 98 is to prevent any of the liquid resin from flowing into the upper section 54 and the lower section 80.

Once the resin has hardened, the lip 98 and positioning flanges 92 and 94 are then removed as by sanding resulting in the edge of the box 52 surrounding the upper section 54 being now flush with the bottom surface 14. The portion of the box 52 that extends beyond the upper surface 12 is also removed by sanding so that this edge of the box 52 is now also flush with the upper surface 12.

What is claimed is:

1. A fin mounting system for a surfboard comprising:

a box adapted to be imbedded within a surfboard, said box having a through opening composed of an upper section and a lower section;

a fin having a mounting end, said mounting end to be snugly retained in a transverse direction within said upper section, said fin being longitudinally adjustable by adjustment means within said upper section;

fastener means connecting with said fin, said fastener means to fix the position of said fin relative to said box; and said box including a leash attachment section, said leash attachment section to connect with a pin, said pin connecting to a lanyard with said lanyard extending exteriorly of said box.

2. A fin mounting system for a surfboard comprising:

a box adapted to be imbedded within a surfboard, said box having a through opening composed of an upper section and a lower section;

a fin having a mounting end, said mounting end to be snugly retained in a transverse direction within said upper section, said fin being longitudinally adjustable by adjustment means within said upper section;

fastener means connecting with said fin, said fastener means to fix the position of said fin relative to said box; and said upper section terminating in rounded ends increasing the length of adjustability of said fin and the overall strength of said box.

3. A fin mounting system for a surfboard comprising:

a box adapted to be imbedded within a surfboard, said box having a through opening;

a fin having a mounting end, said mounting end to be snugly retained in a transverse direction within said through opening, said fin being longitudinally adjustable by adjustment means within said through opening;

fastener means connecting with said fin, said fastener means to fix the position of said fin relative to said box; and said box including a leash attachment section, said leash attachment section to connect with a pin, said pin connecting to a lanyard with said lanyard extending exteriorly of said box.

4. A fin mounting system for a surfboard comprising:

a box adapted to be imbedded within a surfboard, said box having a through opening;

a fin having a mounting end, said mounting end to be snugly retained in a transverse direction within said through opening, said fin being longitudinally adjustable by adjustment means within said through opening;

fastener means connecting with said fin, said fastener means to fix the position of said fin relative to said box; and said through opening terminating in rounded ends increasing the length of adjustability of said fin and the overall strength of said box.

* * * * *

UNITED STATES PATENT AND TRADEMARK OFFICE

CERTIFICATE OF CORRECTION

PATENT NO. : 5,997,376
DATED : December 7, 1999
INVENTOR(S) : Larry A. Block

It is certified that error appears in the above-indentified patent and that said Letters Patent is hereby corrected as shown below:

On the title page, item [54] and column 1, line 1:

Title should read:

SURFBOARD (not SURBOARD)

Signed and Sealed this

Eleventh Day of July, 2000

*Attest:*

Q. TODD DICKINSON

*Attesting Officer*

*Director of Patents and Trademarks*